US005325164A

United States Patent [19]

Tai et al.

[11] Patent Number: 5,325,164

[45] Date of Patent: Jun. 28, 1994

[54] FIXING DEVICE WITH PULLING ROLLERS

[75] Inventors: Akira Tai; Masayuki Hata, both of Hachioji, Japan

[73] Assignee: Konica Corporation, Tokyo, Japan

[21] Appl. No.: 962,986

[22] Filed: Oct. 16, 1992

[30] Foreign Application Priority Data

| | | | |
|---|---|---|---|
| Oct. 24, 1991 | [JP] | Japan | 3-277952 |
| Oct. 29, 1991 | [JP] | Japan | 3-283001 |
| Mar. 24, 1992 | [JP] | Japan | 4-066171 |
| Apr. 1, 1992 | [JP] | Japan | 4-079927 |

[51] Int. Cl.[5] ..... G03G 15/20

[52] U.S. Cl. ..... 355/282; 219/216; 355/285; 355/290

[58] Field of Search ..... 355/282, 285, 290, 294; 219/216, 469–471; 271/273, 274

[56] References Cited

U.S. PATENT DOCUMENTS

| | | | |
|---|---|---|---|
| 4,269,594 | 5/1981 | Umans et al. | 355/290 X |
| 4,339,194 | 7/1982 | Scribner | 219/216 X |
| 4,549,803 | 10/1985 | Ohno et al. | 355/285 X |
| 4,933,726 | 6/1990 | Moriyama | 355/290 X |
| 5,019,869 | 5/1991 | Patton | 355/285 X |
| 5,087,947 | 2/1992 | Torino | 355/290 |
| 5,187,527 | 2/1993 | Forlani et al. | 355/282 |

*Primary Examiner*—A. T. Grimley
*Assistant Examiner*—Shuk Y. Lee
*Attorney, Agent, or Firm*—Jordan B. Bierman

[57] ABSTRACT

In a device for fixing a toner image on a sheet in an image forming apparatus, a pair of pulling rollers is disposed downstream of a heating roller in the direction to convey the sheet and is rotated at a peripheral speed higher than that of the heating roller.

7 Claims, 10 Drawing Sheets

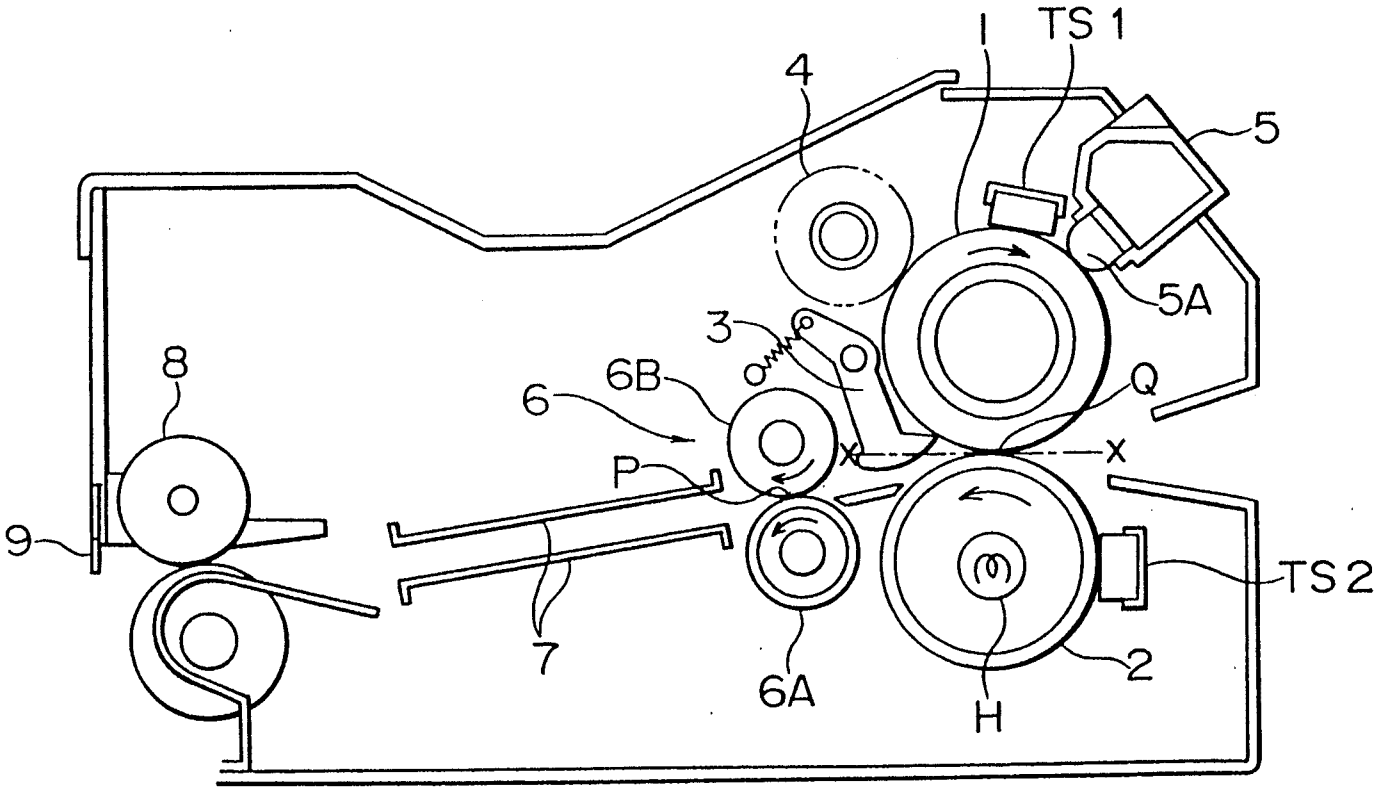
FIG. 1-A

FIG. 1-B
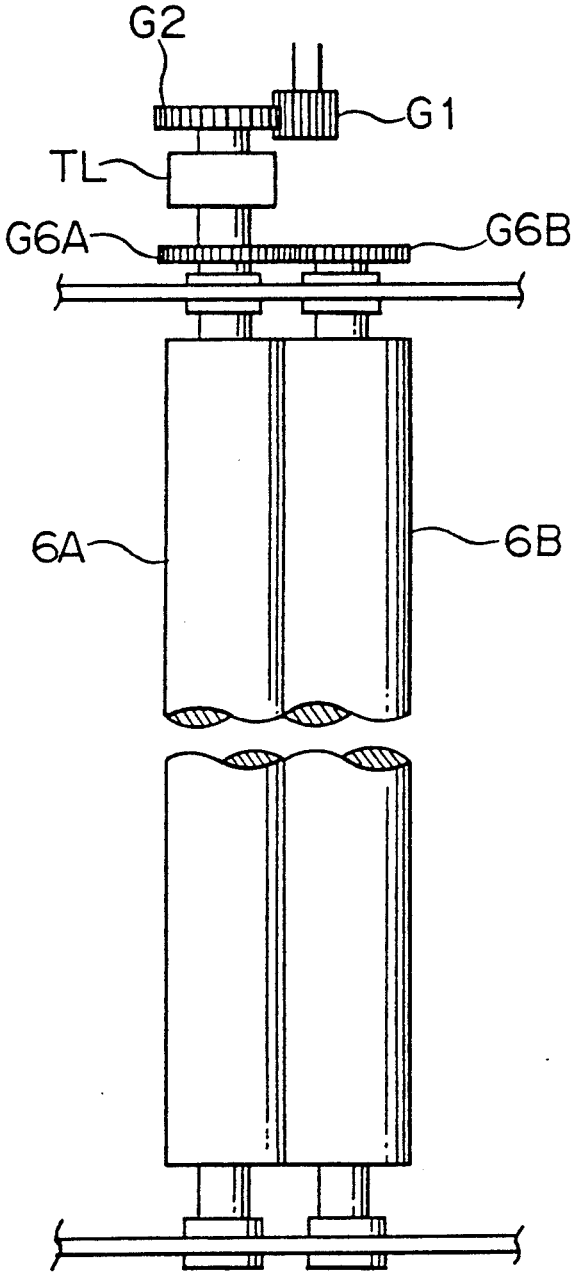

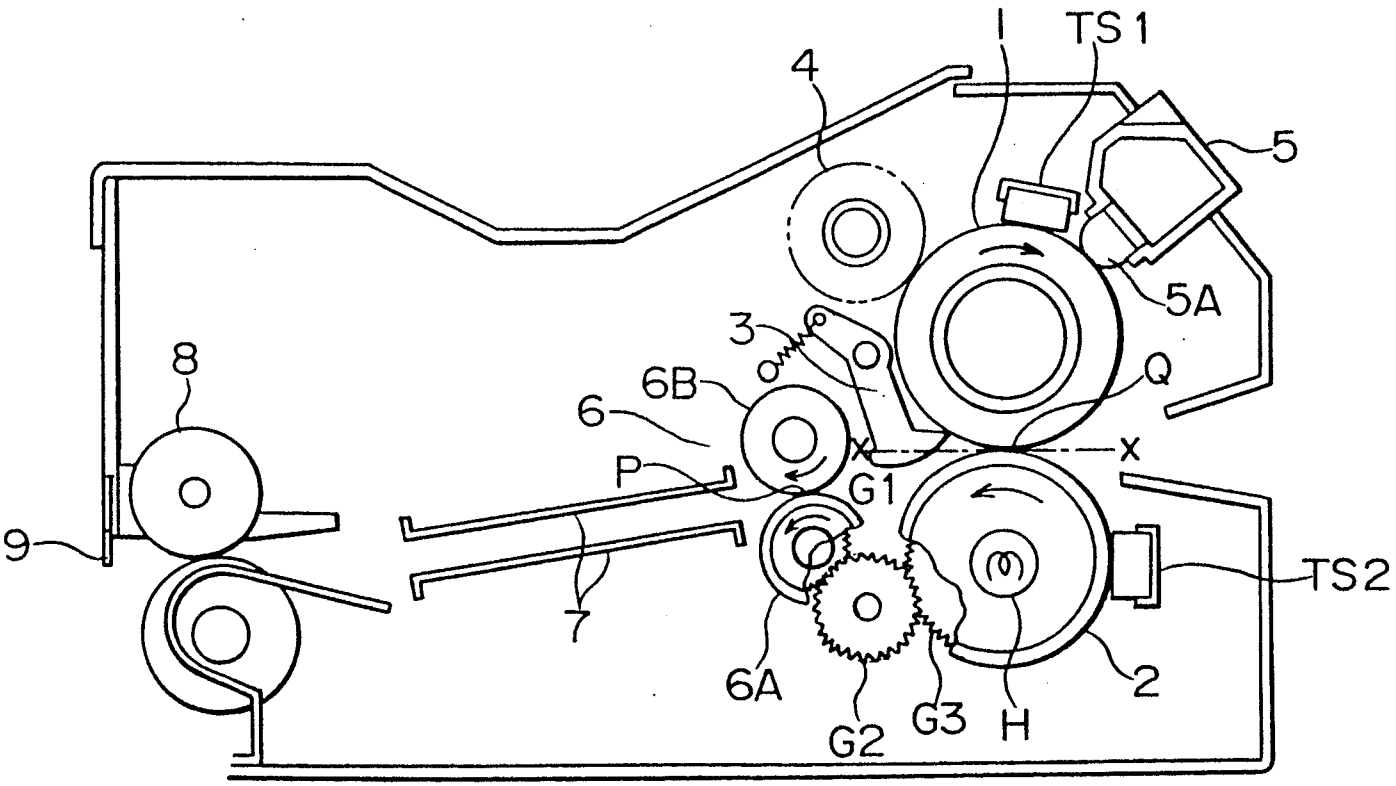
FIG. 2-A

FIG. 2-B
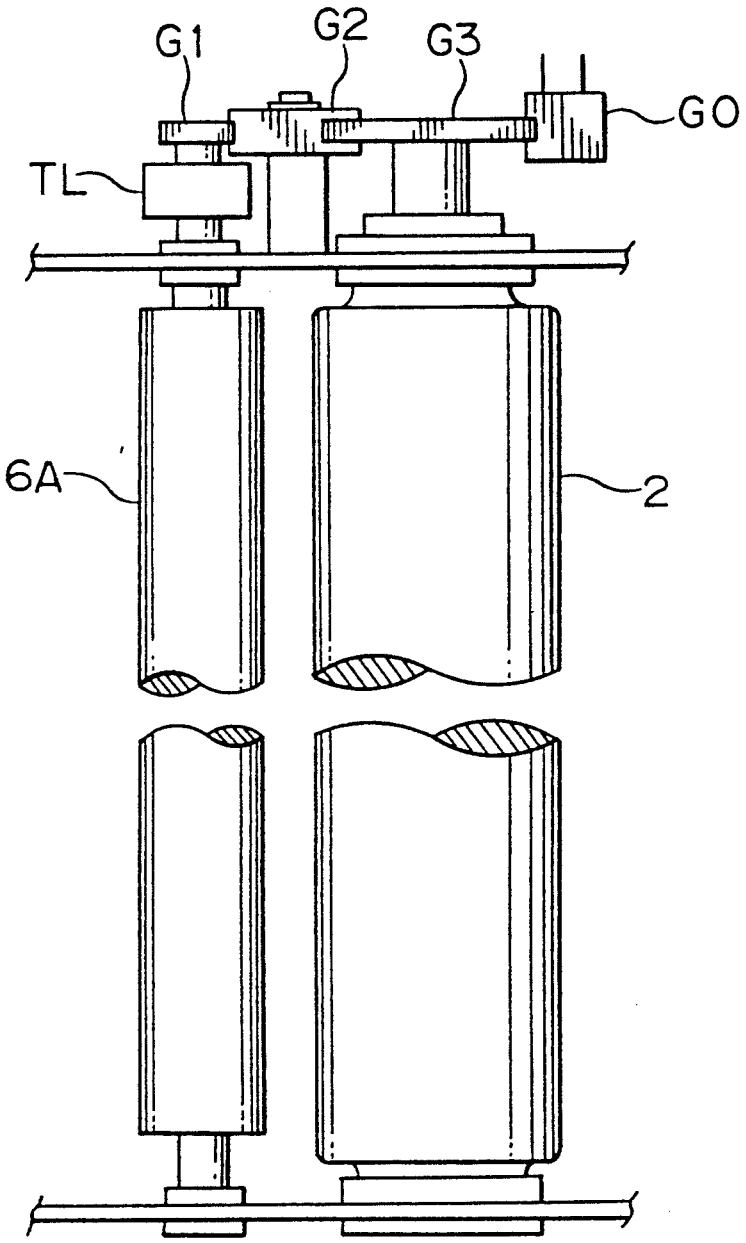

FIG. 5

| | HEATER H1<br>HEATER H2 | FAN | FIXING ROLLER 101<br>PRESSING ROLLER 102 | PRESSING ROLLER 102<br>PRESSING ACTION |
|---|---|---|---|---|
| WARMING UP | ON | OFF | OFF | OFF |
| READY | ON/OFF | OFF | ON | OFF |
| PRINT | ON/OFF | ON | ON | ON |
| PRINT INTERVAL | ON/OFF | OFF | ON | ON |

FIG. 6

°C

| | TRANSFER MEDIA | T1 | T2 | TEMPERATURE DIFFERENCE |
|---|---|---|---|---|
| NONGLOSSY | ORDINARY PAPER | 130 | 130 | 0 |
| | THICK PAPER | 130 | 150 | 20 |
| GLOSSY | TRANSPARENT SHEET | 130 | 180 | 50 |
| | ORDINARY PAPER | 130 | 180 | 50 |

FIXING DEVICE WITH PULLING ROLLERS

BACKGROUND OF THE INVENTION

The present invention relates to a fixing device with pulling rollers for use in image forming apparatuses, such as electronic photographing machines.

Conventionally, images for transparent sheets for use in an overhead projector (OHP) have been chiefly formed by printing or hand writing. Recently, they are often made in an image copying process as electronic photographing copying machines have been made popular.

What is more, those images have been conventionally monochrome ones, but color images have been mainly duplicated as color image forming apparatuses were developed. This allows the OHP to project drawings, graphics, photographs, and the like at a high projection effect.

However, the prior color image forming apparatuses having a fixing device fix a color toner image transferred to a transparent sheet. In this event, a leading part of the sheet can be separated from the heating roller relatively easily, but the following parts are often made too late in separation timing as-they are likely adhered to a surface of the heating roller. This causes the fixed image to lose gloss, resulting in mat image. This tendency occurs, particularly in image transference on the entire sheet.

The color image projected is worse in the color saturation and greatly inferior to the monochrome image in the clearness as the color image formed on the sheet is degraded in the transparency.

In order to correct such a decrease of the separatability of the local parts of the transparent sheet from the heating roller, it was proposed to provide a guide member for changing down a conveying direction of the sheet right behind the heating roller. The proposal has not been employed as the guide member deteriorates the image quality as it has the image surface Just fixed slid thereon.

In view of such a problem as pointed above, it is an object of the present invention to provide a fixing device that increases separatability of a transparent sheet from a heating roller and with this, is capable of fixing highly transparent color images and glossy color images even on ordinary transfer-media.

SUMMARY OF THE INVENTION

Briefly, the foregoing object is accomplished in accordance with aspects of the present invention by the fixing device of heating roller type having a fixing roller and a pressing roller to press the fixing roller, characterized in that the fixing device has a pair of pulling rollers provided at a down stream from the fixing roller and revolved at a higher surface speed than the fixing roller.

Also, the foregoing object is accomplished by the fixing device of heating roller type having a fixing roller and a pressing roller to press the fixing roller, characterized in that a heating temperature T2 on the pressing roller for a rear side of the transfer-media is set higher than a heating temperature T1 on the fixing roller for the transfer-media, and that the fixing device has a pair of pulling rollers provided at a down stream from the fixing roller and revolved at a higher surface speed than the fixing roller.

The fixing device of heating roller type of the present invention having a fixing roller and a pressing roller to press the fixing roller, has a pair of pulling rollers comprising a rigid upper roller and a elastic lower roller of 20° to 80° hardness pressed to the upper roller, a pressing point of the pair of pulling rollers being below a tangent of a pressing point of the fixing roller and the pressing roller.

The fixing device has a pair of pulling rollers revolved at a peripheral speed 1.5 times or higher than the fixing roller in position below a tangent of a pressing point of the fixing roller and the pressing roller.

The fixing device has a pair of pulling rollers driven through a torque limiter of 0.2 to 4 kg-cm in position below a tangent of a pressing point of the fixing roller and the pressing roller.

The fixing device is characterized in that a heating temperature T2 on the pressing roller for a rear side of the transfer-media is set higher than a heating temperature T1 on the fixing roller for the transfer-media, and that the fixing device has a pair of pulling rollers comprising a rigid upper roller and a elastic lower roller of 20° to 80° hardness pressed to the upper roller, a pressing point of the pair of pulling rollers being below a tangent of a pressing point of the fixing roller and the pressing roller.

BRIEF DESCRIPTION OF THE DRAWINGS

FIG. 1-A is a cross-sectioned view for a fixing device of a first embodiment according to the present invention.

FIG. 1-B is a plan view for major parts of the fixing device shown in FIG. 1-A.

FIG. 2-A is a cross-sectioned view for a fixing device of a second embodiment according to the present invention.

FIG. 2-B is a plan view for major parts of the fixing device shown in FIG. 2-A.

FIG. 5 is operational states of component parts of the fixing device according to the present invention.

FIG. 6 is a table showing examples of the surface temperatures in glossy and nonglossy modes of fixing process for transfer-media.

DETAILED DESCRIPTION OF THE PREFERRED EMBODIMENTS

Figure 3:
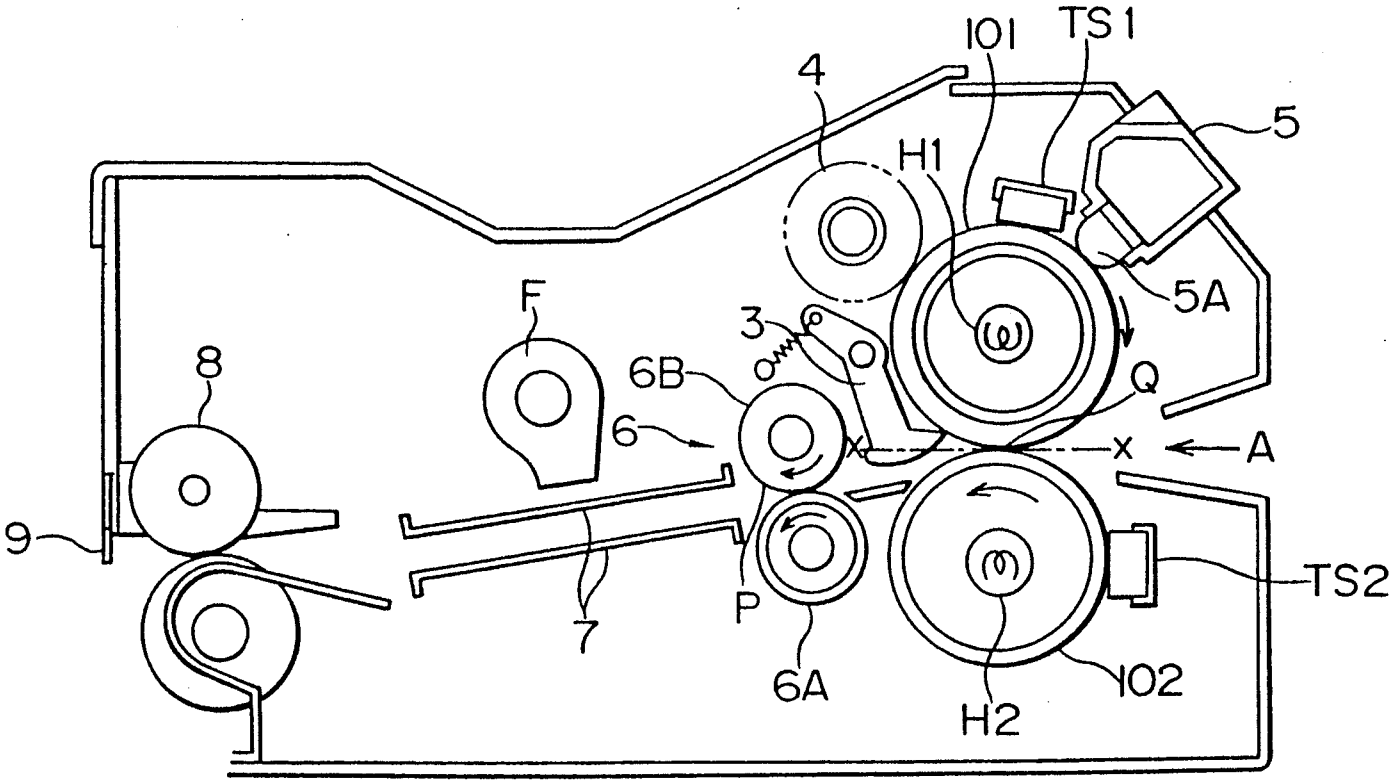
FIG. 3 is a cross-sectioned view for a fixing device of a second embodiment according to the present invention.

The following describes in detail a first embodiment according to the present invention for a fixing device by reference to FIGS. 1-A and 1-B.

FIG. 1-A is a cross-sectioned view for the fixing device. FIG. 1-B is a plan view for major parts of the fixing device. The fixing device of the present invention is assembled into an independent container as a unit to be coupled with a drive system and a power supply in an image forming apparatus body.

There is provided a fixing roller 1 rotatably supported in position by bearing in the fixing device. The fixing roller 1 has elastic thermostable rubber covered on a surface thereof.

There is also provided a metal pressing roller 2 having a heater H built therein. The pressing roller 2 is pressed upward to the fixing roller 1, and is revolved counterclockwise by the drive system of the image forming apparatus and at the same time, revolves the fixing roller 1 clockwise.

Surface temperatures of the fixing roller 1 and pressing roller 2 are detected by temperature sensors TS1 and TS2, respectively, for a control system of the image forming device to control to predetermined values.

A plurality of separating pawls 3 for transfer-media are arranged in parallel with an axis of the fixing roller 1 and pressed to the surface of the fixing roller 1.

A cleaning roller 4 is for the fixing roller 1. Brush on an outside surface of the cleaning roller 4 is made to contact the surface of the fixing roller 1 and is revolved by the fixing roller 1 in the same direction.

An oil impregnated part of an oil supply device 5 is always made to contact of the surface of the fixing roller 1 to apply silicon oil to it to make easy separation of the transfer-media from the fixing roller 1.

A pair of pulling rollers 6 which is involved in the present invention comprises a lower roller 6A having thermostable rubber of 20° to 80° hardness formed on its outside surface and an upper lower 6B of aluminum alloy or similar metals pressed to the lower roller 6A.

A pressing point P of the lower roller 6A and the upper roller 6B is positioned a little lower than a tangent XX passing a pressing point Q of the pressing roller 2 to the fixing roller 1, and is made as close as possible to the fixing roller 1.

The lower roller 6A and the upper roller 6B, as shown in FIG. 2, have a gear G6A and a gear G6B of the same number teeth integrated therewith on the same axes, respectively, which are engaged together. The lower roller 6A further is coupled with a torque limiter TL for a gear G2 engaged with a drive gear G1 to be connected to a power system of a developing assembly (not shown). The lower roller 6A is revolved counterclockwise, and the upper roller 6B is revolved clockwise at the same circular speed.

The torque limiter TL used can limit torque range in 0.2 to 4 kg-cm.

The pair of pulling rollers 6 further is driven at a peripheral speed 1.5 or more times that of the fixing roller 1. For example, in nonglossy fixing of monochrome image, the peripheral speed of the pair of pulling rollers 6 is set to 120 mm/sec while that of the fixing roller 1 is at 72 mm/sec; in glossy fixing of color image, that of the pair of pulling rollers 6 is set to 70 to 80 mm/sec while that of the fixing roller 1 is at 10 mm/sec.

The following describes in detail a second embodiment according to the present invention for a fixing device by reference to FIGS. 2-A and 2-B. A pair of pulling rollers 6 of the second embodiment comprises a drive roller 6A having thermostable rubber of EPDM or the like formed on its outside surface and a slave lower 6B of metal or hard plastics pressed to the slave roller 6A.

The drive roller 6A has a torque limiter TL mounted on its axial end. A gear G1 of the torque limiter TL is connected through an intermediate gear G2 to a gear G3 of a pressing roller 2. The gear G1 is revolved together with the pressing roller 2 in the same direction, or counterclockwise, at a peripheral speed around seven times that of the pressing roller 2 by a drive gear G0 of a power system in an image forming apparatus.

The drive roller 6A is positioned at a down-stream of process where its pressing point P with the slave roller 6B is below, but not exceeding 50 mm, a tangent XX passing a pressing point Q of the pressing roller 2 to a fixing roller 1.

The following describes a fixing process of a toner image on a transparent sheet by means of the fixing device according to the first and second embodiments described above.

If the transparent sheet (hereinafter referred to as the sheet) having the color toner image transferred on an outside thereof is conveyed into the fixing device, then it has the toner image deposited on the outside by heat and pressing in the course of conveying as pinched by the fixing roller 1 and pressing roller 2.

The sheet having had the toner image deposited and fixed thereon is easily separated from its leading edge of the fixing roller 1 before being moved straight at least 50 mm, passed under a separating pawl 3, and conveyed into the pair of pulling rollers 6 at a steady speed.

Carrying the sheet by the pair of pulling rollers 6 is made so that it can be drawn in without slipping by friction of the outside surface of the elastic lower roller 6A.

The sheet conveyed by the pair of pulling rollers 6 is forced in a direction of separation from the fixing roller 1 one by one after having passed the pressing point Q as it is tensed at the speed of at least 1.5 times by pinching of the lower roller 6A and the upper roller 6B.

As a result, separation of the sheet from the outside surface of the fixing roller 1 is made good on the entire area thereof. The color image fixed is magnificent in the gloss, high in the transparency, and excellent in the tone.

Note that if the tensile strength applied to the sheet increases excessively, conveying the sheet is made intermittent to prevent the sheet from being deformed or broken. This can be made in a way that the torque limiter TL interrupts power transmission of the gear G1 from the lower roller 6A which is the drive roller.

An allowable tensile strength of the pair of pulling rollers 6 for the sheet should be set in the above-mentioned torque range of the torque limiter TL in which the sheet or the transfer-media can be thoroughly conveyed, and no wrinkle nor deformation should be caused on the generally used transfer-media. This permits the fixing process to be made not only on the sheet for an OHP, but also for the color toner image transferred to the ordinary paper.

The sheet separated from the fixing roller 1 as described above is made to pass a conveying guide 7 and discharged by a discharging brush 9 before being put out of the fixing device through a paper feed-out roller 8.

FIG. 3 shows a cross-sectioned view for the fixing device of a third embodiment according to the present invention. This is closely similar to that of the first embodiment. The arrangements and parts in the figure identical with those in FIG. 1 are indicated by the same numbers as in FIG. 1. The following describes different portions only. The fixing roller 101 and the pressing roller 102 in the third embodiment have heaters H1 and H2 of virtually equal calorific value, for example, around 400 W, built therein, respectively. An outside surface of each of the fixing roller 101 and the pressing roller 102 has a thermostable synthetic rubber layer of silicon rubber. An outside surface temperature is controlled as it is detected by the respective temperature sensors TS1 and TS2. A guide plate of the conveying guide 7 has a plurality of slit holes formed thereon. A fan F is provided near the conveying guide 7. The fan F sucks air from the outside of the fixing device and blows it through the slit holes to cool the outside of the transfer-media.

If the transfer-media having the toner image transferred on the outside is fed into the fixing device in a direction A, the transfer-media is heated on the outside and the inside at the same time at the pressing point Q by the fixing roller 101 and the pressing roller 102 until the toner is melted. In particular, as heating is made on the inside of the transfer-media, the melted toner can be penetrated into the transfer-media enough to fix the toner image firmly, resulting in excellent gloss without offset.

Controlling the fixing temperatures in the fixing device is made as follows.

Figure 4:
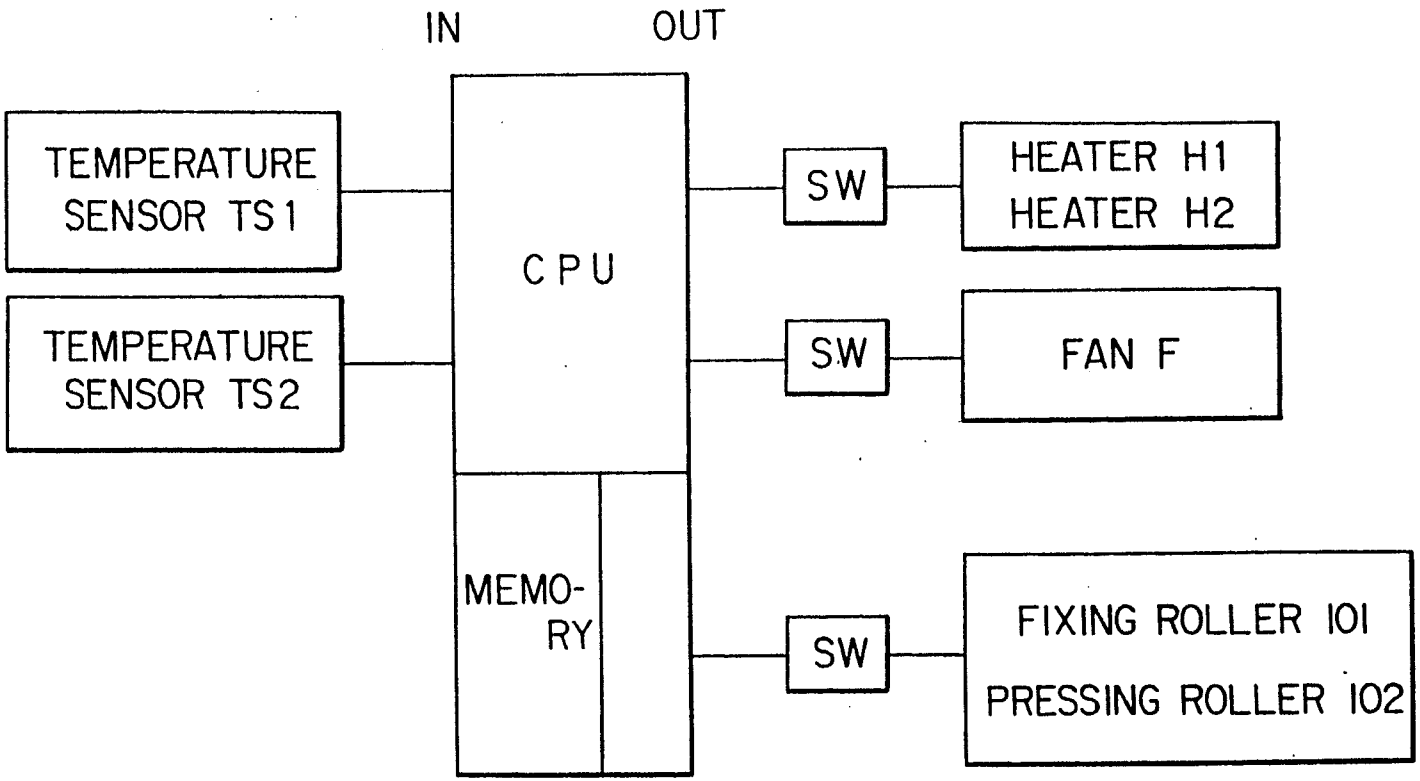
FIG. 4 is a temperature control circuit according to the present invention.

FIGS. 4 and 5 show a temperature control circuit and process by the temperature sensors TS1 and TS2. If the fixing device is at a warm-up stage, the heaters H1 and H2 are on, but the fan F and the fixing roller 101 and the pressing roller 102 are all off. The pressing roller 102 therefore is released (off) from pressing.

If the fixing roller 101 and the pressing roller 102 reach to the respective predetermined surface temperatures, or a ready stage for fixing, after the warm-up, then the heaters H1 and H2 are repeatedly turned on or off to keep a fixing temperature for the transfer-media constant. At the same time, the fixing roller 101 and the pressing roller 102 start conveying the transfer-media.

If print is made in the image forming apparatus at the ready stage, the pressing roller 102 is made to press (on) and the fan F starts revolution (on) for execution of conveying the transfer-media and fixing the toner image.

In a print interval between discharge of the transfer-media after fixing and feed-in of a successive transfer-media, the fan F is halted (off) to interrupt unnecessary cooling in the fixing device.

In the fixing device of the present invention, the heating temperature on the inside of, or the rear side of, the transfer-media is set a little higher than that of the toner image side of the transfer-media. This accomplishes quality fixed image of high resolution having excellent gloss without offset phenomenon.

The heating temperature on the toner image side, that is, a surface temperature T1 of the fixing roller 101, is limited to 130° C. at which the toner can be melted at large. This can avoid excessive melting of the toner, resulting in quality fixed image of high resolution without grinning.

On the other hand, the heating temperature on the rear side, that is, a surface temperature T2 of the pressing roller 102, is set at a higher temperature than the above-mentioned surface temperature T1 of the fixing roller 101. This can make the melted toner to be penetrated and adsorbed into the transfer-media enough to fix the toner image further firmly. The adsorption of the toner into the transfer-media can be increased further by making larger a nip width of the pressing roller 102 for the fixing roller 101 and by making late the conveying speed of the transfer-media.

The transfer-media having adsorbed the melted toner is quickly cooled in the course of conveying by the fan F to make the toner from semi-melting state to fixing state before being separated as the one having the glossy image without transmitting the toner to the fixing roller 101.

A temperature difference the surface temperature T2 of the pressing roller 102 from the surface temperature T1 of the fixing roller 101 is set in a range of 10° to 60° C. by the temperature detections of the temperature sensors TS1 and TS2 except for thin ordinary paper.

FIG. 6 is a table showing examples of the surface temperatures T1 and T2 in the glossy and nonglossy modes of fixing process for the transfer-media.

Figure 7:
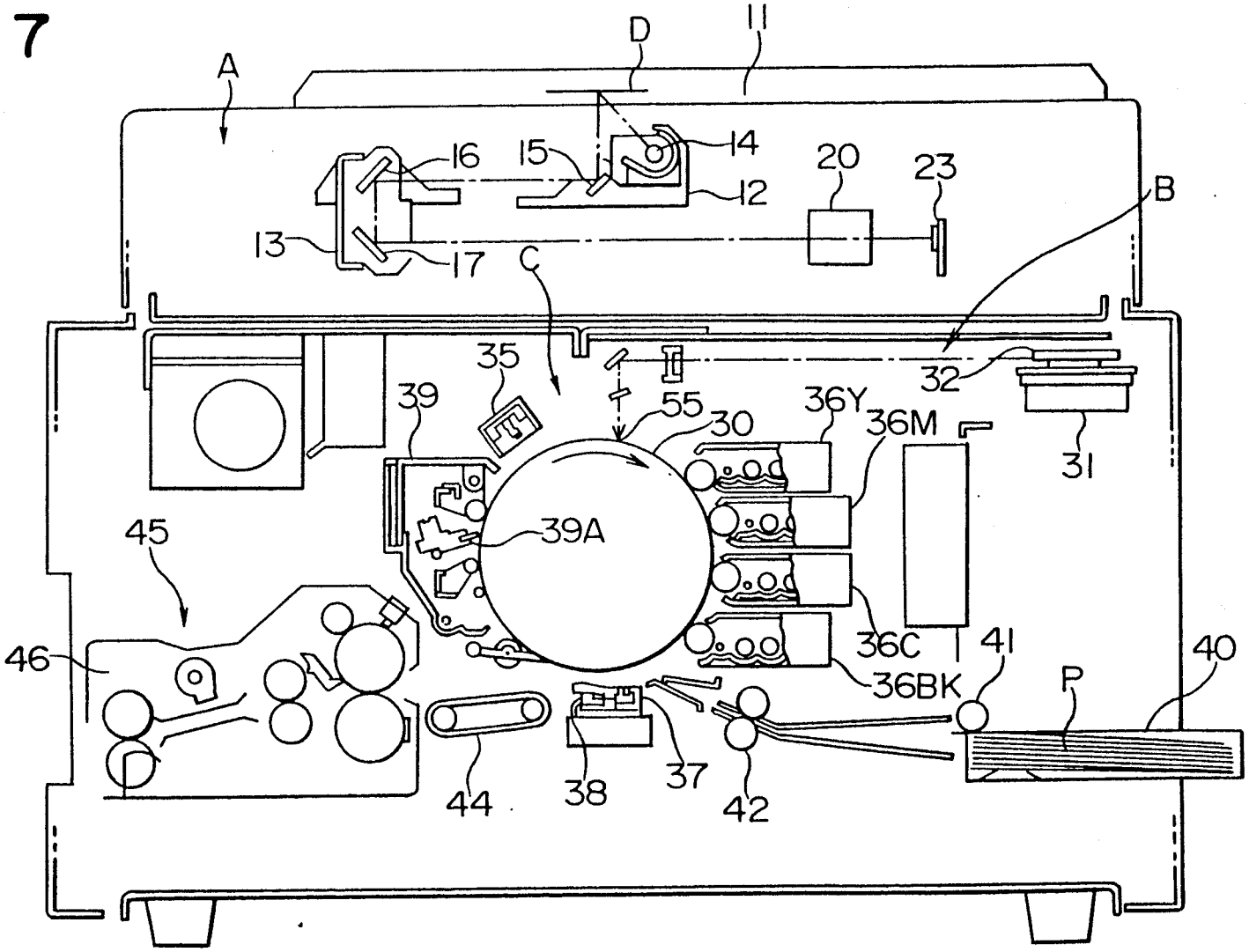
FIG. 7 is a cross-sectioned view for an example of a color image forming apparatus having the fixing device of the present invention built therein.

FIG. 7 is a cross-sectioned view for an example of the color image forming apparatus having the fixing device of the present invention built therein. The color image forming apparatus comprises an image reading system A, a laser writing system B, and an image forming section C.

The image forming apparatus has at a top thereof a document placing section 11 comprising a document table of transparent glass plate and a document holder for covering a document D put on the document table. The apparatus body has under the document table the image reading system A comprising a first mirror unit 12, a second mirror unit 13, a main lens 20, and a color CCD 23. The first mirror unit 12 has an exposure lamp 14 and a first mirror 15, and is mounted movably in parallel with the document table and straightly right and left in the figure to optically scan the entire surface of the document D. The second mirror unit 13 has a second mirror 16 and a third mirror 17 integrated therewith, and is straightly moved with the first mirror unit 12, but at a half speed of that of the first mirror unit 12. Of course, the motion of the second mirror unit 13, like the first mirror unit 12, is in parallel with the document table. An image of the document D on the document table illuminated by the exposure lamp 14 is focused onto the color CCD 23 through the first mirror 15, the second mirror 16, and the third mirror 17 by the main lens 20. After scanning, the first mirror unit 12 and the second mirror unit 13 are returned to the respective home positions, and wait for the next copying.

Image data of color components obtained by the color CCD 23 are image-processed and fed out of the laser writing system B as image signal.

The image forming section C has a charger 35, an image exposing portion 55, developing devices 36Y, 36M, 36C, and 36BK, a transfer device 37, a separator 38, and a cleaning device 39 arranged around a photosensing drum 30 of image forming body thereof. The image forming section C also has a sheet supply cassette 40 and a conveying belt 44 and the fixing device 45 of the present invention arranged near the photosensing drum 30.

As for the developing devices 36Y, 36M, 36C, and 36BK, the developing device 36Y is placed at the most upper stream around the photosensing drum 30, and the developing device 36BK containing black toner BK is at the most down stream. Description of color toners and the black toner BK for use in the developing devices 36Y, 36M, 36C, and 36BK is ignored here as they are known.

If the copy button is pressed, the image reading system A, the laser writing system B, and the image forming section C start operation to form color copy image. That is, if a CPU in a control section controls to feed the image signal from the image reading system A into the laser writing system B comprising a drive motor 31, a polygon mirror 32, a semiconductor laser (not shown), f*t lens (not shown), a compensation lens (not shown), then copying operation starts. The copying operation is made in a way that the photosensing drum 30 is revolved clockwise as indicated by arrow to have charge given uniformly by the charger 35. The laser writing system B writes a yellow (Y) image corresponding to the image of the document D at the image exposing portion 55 by laser beam to form a electrostatic latent image of the Y image. The electrostatic latent image on the photosensing drum 30 is inverse-developed with Y toner to a visible Y toner image by the developing device 36Y. That is, a developing sleeve of the developing device 36Y having a magnet roll built therein has a dc and ac bias voltage applied thereto, and has non-contact development made with a two-component developing agent of developing means to have the Y toner image formed thereon. The photosensing drum 30 having the Y toner image formed thereon passes below the cleaning device 39 having sided. The photosensing drum 30, in turn, has charge made by the charger 35, and has a magenta (M) image written thereon with laser beam by the laser writing system B to have an electrostatic latent image of the magenta (M) image formed on the Y toner image. The latent image is inverse-developed to a M toner image by the developing device 36M containing magenta toner. Similarly, a cyan (C) toner image and a black (BK) toner image are superimposed on the two toner images. If the document D is of monochrome image, only the developing device 36BK operates for forming a toner image of black toner BK alone.

In turn, transfer-media P fed out of the sheet supply cassette 40 one by one by a sheet supply roller 41 is fed onto the photosensing drum 30 by a timing roller 42 synchronized with the toner image on the photosensing drum 30. The transfer-media P has the toner image transferred from the photosensing drum 30 by the transfer device 37 before being separated from the photosensing drum 30 by the separator 38. The transfer-media P then is fed to the fixing device 45 through the conveying belt 44 with the toner image directed upward.

The transfer-media P having the toner image fixed by the fixing device 45 is fed out of the apparatus through a sheet feed-out roller 46. The photosensing drum 30, on the other hand, continues revolution until the toner not transferred but remaining on the surface thereof is collected and cleaned off by the cleaning device 39 having a cleaning blade 39A released from siding, and waits for the next copying.

Figure 8:
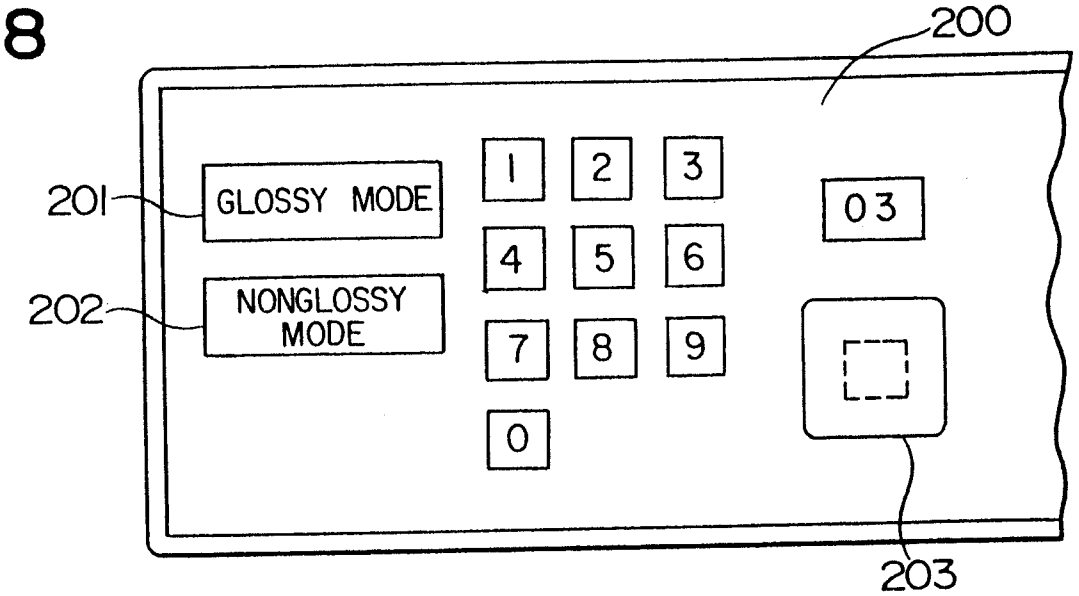
FIG. 8 is a plan view for an operation panel of the color image forming apparatus shown in FIG. 7.

The color image forming apparatus described above can select either of the glossy or nonglossy mode. A user can select a any desired mode corresponding to a desired degree of gloss of an image to be copied using an operation panel 200 shown in FIG. 8.

That is, the user should press a glossy button 201 for glossy copy of the image, or a nonglossy button 202 for nonglossy copy.

Figure 9:
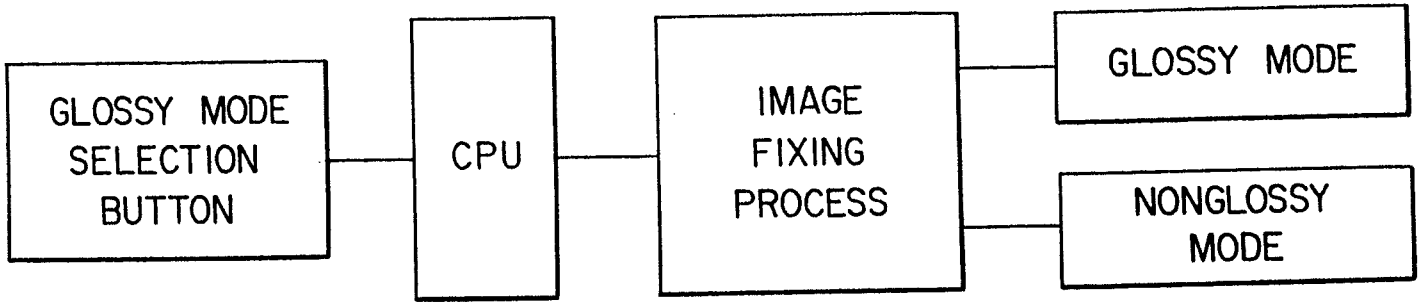
FIG. 9 is a block diagram for a control circuit of the color image forming apparatus shown in FIG. 7.

Then, as shown in FIG. 9, the control section has data of the selected mode input thereto. The CPU processes the copy image to be fixed according to the following image forming way depending of the selected glossy or nonglossy mode.

That is, if the nonglossy mode is set with the nonglossy button 202 pressed, the surface temperature T1 of the fixing roller 101 and the surface temperature T2 of the pressing roller 102 are all controlled to 130° C. on the basis of data from the temperature sensors TS1 and TS2 for fixing a mat image. If the glossy mode is set with the glossy button 201 is pressed, as described above, the outside and inside of the transfer-media are heated at T1 of 130° C. and T2 of 180° C. on the bases of data from the temperature sensors TS1 and TS2, and the fixing speed is also made low. This allows fixing a highly transparent image for a transparent sheet or a glossy image for an ordinary sheet.

Advantages of the Invention

The fixing device according to the present invention can fix a highly transparent color image on a transparent sheet or a glossy color image on an ordinary sheet.

The present invention provides the fixing device that can increase separatability of the transfer-media from the heating roller to a great extent and as a result, can fix highly transparent and color saturative color image even onto transparent transfer-media, such as sheets for OHP.

What is claimed is:

1. A device for fixing a toner image on an image-receiving surface of a sheet formed of paper or plastic, in an image forming apparatus, said device comprising:

a fixing roller rotating at a peripheral speed;

a pressing roller disposed beneath and in pressing contact with said fixing roller whereby, when a sheet having a toner image is conveyed through a contact point between said fixing roller and said pressing roller, an image recovering surface bearing a toner image thereon is brought into contact with said fixing roller;

a pair of pulling rollers being brought into contact with each other, said pulling rollers being disposed downstream of said fixing roller in a direction in which said sheet is conveyed so that the image receiving surface bearing said toner image thereon is brought into contact with an upper roller of said pulling rollers, said pulling rollers rotating at a peripheral speed higher than that of said fixing roller, the upper roller of said pulling rollers being a rigid roller and a lower roller being an elastic roller having a hardness of 20° to 80°, wherein a contact portion between said pair of pulling rollers is disposed lower than a tangent line passing through a contact portion between said fixing roller and said pressing roller, whereby said pair of pulling rollers pull said sheet downwardly to separate said image receiving surface bearing said toner image from said fixing roller.

2. The device of claim 1, wherein the pair of pulling rollers is positioned within 50 mm of said fixing roller.

3. The device of claim 1, wherein the pulling rollers rotate at a peripheral speed 1.5 times faster than that of said fixing roller.

4. The device of claim 1, wherein the pulling rollers are driven through a torque limiter to allow the torque within the range of 0.2 kgcm to 4 kgcm to transmit.

5. The device of claim 1, wherein a heating temperature T1 of said fixing roller to heat the toner image surface of the sheet is lower than that T2 of the pressing roller to heat the back surface of the sheet.

6. The device of claim 5, wherein the difference between T1 and T2 is controlled to be within a range of 10° C. to 60° C.

7. A device for fixing a toner image on a sheet in an image forming apparatus, wherein said sheet comprises either paper or plastic, said device comprising;

a fixing roller rotating at a peripheral speed;

a pressing roller being brought into contact with said fixing roller, wherein a sheet having a toner image thereon is conveyed through a contact portion between said fixing roller and said pressing roller; and a pair of pulling rollers disposed downstream of said fixing roller in a direction in which said sheet is conveyed, said pair of pulling rollers being rotated at a peripheral speed higher than that of said fixing roller, wherein said pulling rollers are driven through a torque limiter to allow a torque within a range of 0.2 to 4.0 kgcm to be transmitted.

* * * * *